US010359196B2

(12) United States Patent
Harris et al.

(10) Patent No.: US 10,359,196 B2
(45) Date of Patent: Jul. 23, 2019

(54) FIRE PIT CONTROL AND ACCESS PANEL

(71) Applicant: Mr. Bar-B-Q Products LLC, Melville, NY (US)

(72) Inventors: Aaron E. Harris, Winston Salem, NC (US); Richard H. Harris, Winston Salem, NC (US)

(73) Assignee: MR. BAR-B-Q PRODUCTS LLC, Melville, NY (US)

( * ) Notice: Subject to any disclaimer, the term of this patent is extended or adjusted under 35 U.S.C. 154(b) by 349 days.

(21) Appl. No.: 15/455,871

(22) Filed: Mar. 10, 2017

(65) Prior Publication Data

US 2017/0261210 A1 Sep. 14, 2017

Related U.S. Application Data

(60) Provisional application No. 62/306,582, filed on Mar. 10, 2016.

(51) Int. Cl.

| | |
|---|---|
| ***F24B 1/181*** | (2006.01) |
| ***F24C 3/02*** | (2006.01) |
| ***F24C 3/12*** | (2006.01) |
| ***F24C 3/08*** | (2006.01) |
| ***F24C 3/10*** | (2006.01) |

(52) U.S. Cl.

CPC ..... *F24C 3/022* (2013.01); *F24B 1/181* (2013.01); *F24C 3/08* (2013.01); *F24C 3/10* (2013.01); *F24C 3/12* (2013.01)

(58) Field of Classification Search

CPC .... F24C 3/022; F24C 3/08; F24C 3/10; F24C 3/12; A47J 37/0781; F24B 1/181; F24B 1/192; F24B 1/195; F24B 1/199

See application file for complete search history.

(56) References Cited

U.S. PATENT DOCUMENTS

| | | | | |
|---|---|---|---|---|
| 5,327,879 | A * | 7/1994 | Ferraro | A47J 37/0786 126/39 E |
| 5,937,846 | A * | 8/1999 | Martin | F23N 1/007 126/39 E |
| 2008/0257334 | A1* | 10/2008 | Brunner | A47J 37/0713 126/39 R |
| 2012/0222668 | A1 | 9/2012 | Unger | |
| 2017/0030584 | A1 | 2/2017 | Mueller et al. | |
| 2018/0055218 | A1 | 3/2018 | Mueller | |

* cited by examiner

*Primary Examiner* — Alfred Basichas

(74) *Attorney, Agent, or Firm* — Carter, Deluca & Farrell LLP

(57) ABSTRACT

A fire pit apparatus is provided. The fire pit apparatus includes an enclosure; a burner assembly comprising a burner, wherein the burner is positioned on or at least partially within the surface of the enclosure; at least one control assembly; an elongate hollow member extending from the burner assembly to a distal end, the elongate hollow member being operatively and fluidly connected to the burner assembly and control assembly; and wherein, the enclosure defines a first aperture and a first compartment and a second aperture and a second compartment, wherein the first aperture provides access to the first compartment and the second aperture provides access to the second compartment and wherein the second compartment defines a third aperture that provides access to the first compartment.

12 Claims, 4 Drawing Sheets

FIRE PIT CONTROL AND ACCESS PANEL

FIELD

The invention relates generally to a fire pit apparatus and, more particularly, relates to the control and access panel of a fire pit apparatus.

BACKGROUND

Fire pits have been around for many years and are designed to contain a fire and prevent it from spreading. In general, fire pits provide warmth and ambience and are most often used outdoors, such as in outdoor patio areas. Fire pits are available in both built-in configurations, e.g., physically mounted or secured in or to the ground, and free-standing configurations, e.g., a portable fire pit constructed from a ceramic material, such as stone or brick, metal or other material, that can be placed by the user in a desired location. Typically, fire pits are fueled by natural gas, propane, or bioethanol, but wood burning fire pits are also available. Gas-fueled fire pits typically have an enclosure defining an internal compartment of sufficient dimensions to house a fuel tank. The fuel tank has a valve assembly allowing the user to dispense fuel from the tank. Gas-fueled fire pits also typically have a burner assembly with a burner and an ignitor, hose or piping extending from the burner assembly to the fuel tank with a connector at the distal end configured to matingly engage the valve assembly of the fuel tank, and a control assembly operatively and fluidly connected to the hose or piping between the fuel tank and the burner assembly to allow the user to adjust the amount of fuel being delivered from the fuel tank to the burner assembly and, thus, the size and intensity of the fire in the fire pit. Such control assemblies typically also enable the user to control (i.e., activate) the ignitor of the burner assembly and typically include at least one valve connected to the hose or piping between the fuel tank and the burner assembly that allow the user to adjust the amount of fuel being delivered from the fuel tank to the burner assembly.

One problem associated with conventional fire pits is that in an effort to fully conceal the fuel tank, the valve assembly on the fuel tank is rendered inaccessible or accessible by the user with great effort. The present invention provides a fire pit apparatus with an ergonomically designed and posited control and access panel that enables the user to easily access both the valve assembly of the fuel tank as well as the control assembly of the burner.

BRIEF SUMMARY OF THE INVENTION

Embodiments of the present invention comprise a fire pit apparatus having an enclosure, a burner assembly comprising a burner, and a control assembly. The fire pit apparatus includes an elongate hollow member extending from the burner assembly to a distal end, the elongate hollow member being operatively and fluidly connected to the burner assembly and the control assembly. In one embodiment, the burner is positioned on or at least partially within the surface of the enclosure. In another embodiment, the burner assembly comprises an ignitor and wherein the ignitor is operatively connected to the at least one control assembly.

The enclosure defines a first aperture and a first compartment and a second aperture and a second compartment. The first aperture provides access to the first compartment and the second aperture provides access to the second compartment and wherein the second compartment defines a third aperture that provides access to the first compartment. In one embodiment, the enclosure comprises a door either within or adjacent to the first aperture, wherein the door is structured to be moved between an open position providing access to the first compartment and a closed position restricting access to the first compartment. In another embodiment, the enclosure comprises a door either within or adjacent to the second aperture, wherein the door is structured to be moved between an open position providing access to the second compartment and a closed position restricting access to the second compartment. In yet another embodiment, the enclosure comprises a rotatable connector attached to the door, and wherein the connector is secured to the door in a position that is offset from the center of the door so that the length from the connector to one end of the door is greater than the length from the connector to the opposite end of the door thereby dividing the door into a long section and a short section, wherein the enclosure defines a fourth aperture structured to receive the short section of the door when the door is in the open position. In one embodiment, the fourth aperture provides access to the first compartment.

In one embodiment, the fire pit apparatus also comprises a gaseous fuel source, the fuel source comprising a shut-off valve. The elongate hollow member of the fire pit apparatus is operatively and fluidly connected to the burner assembly, control assembly and the fuel source. The first compartment contains the shut-off valve of the fuel source, wherein the first aperture provides access to the first compartment and the second aperture provides access to the second compartment and wherein the second compartment defines a third aperture that provides access to the first compartment and the shut-off valve.

Thus, the present invention provides a fire pit apparatus with an ergonomically designed and posited control and access panel that enables the user to easily access both the valve assembly of the fuel tank as well as the control assembly of the burner.

BRIEF DESCRIPTION OF THE SEVERAL VIEWS OF THE DRAWINGS

Figure 1:
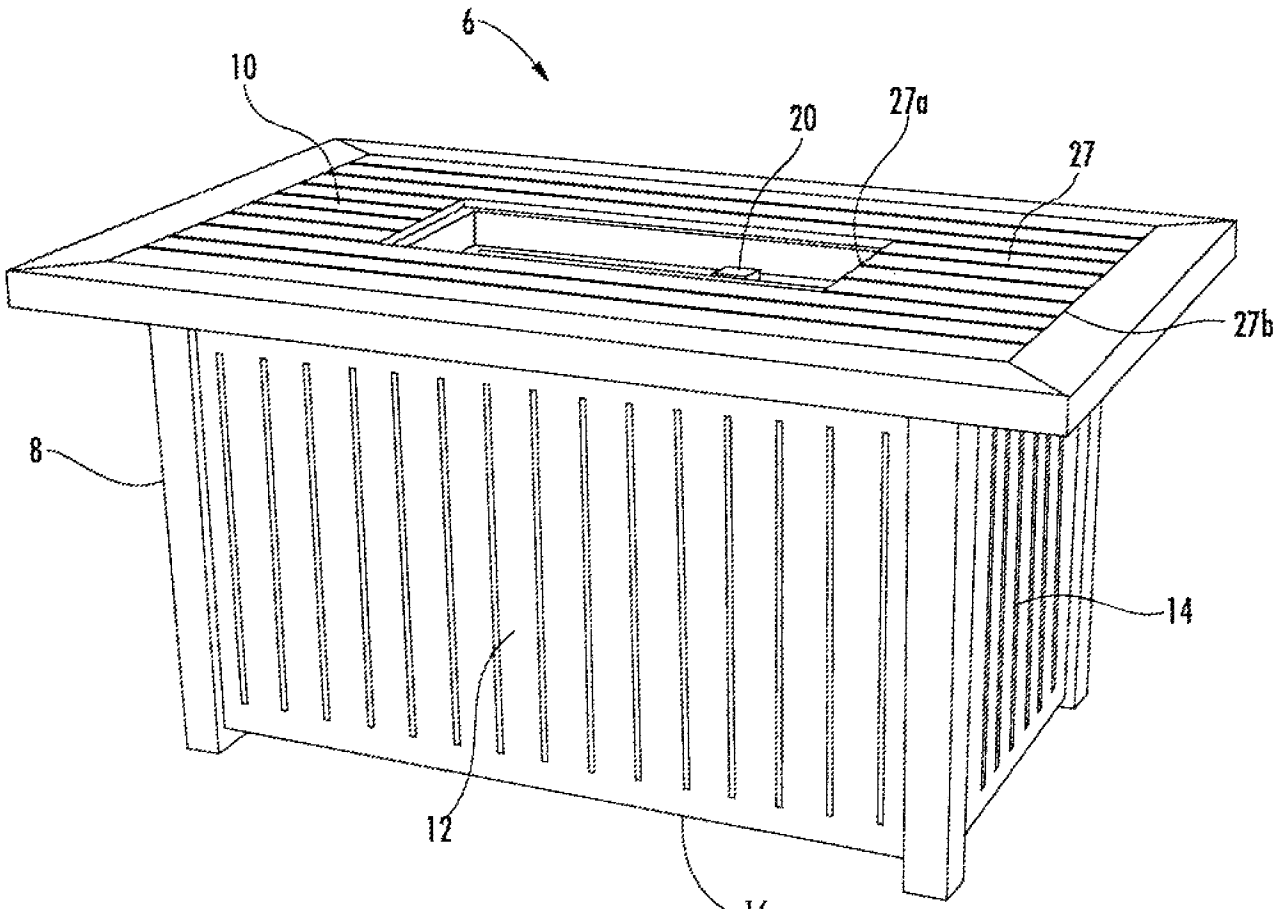
Figure 2:
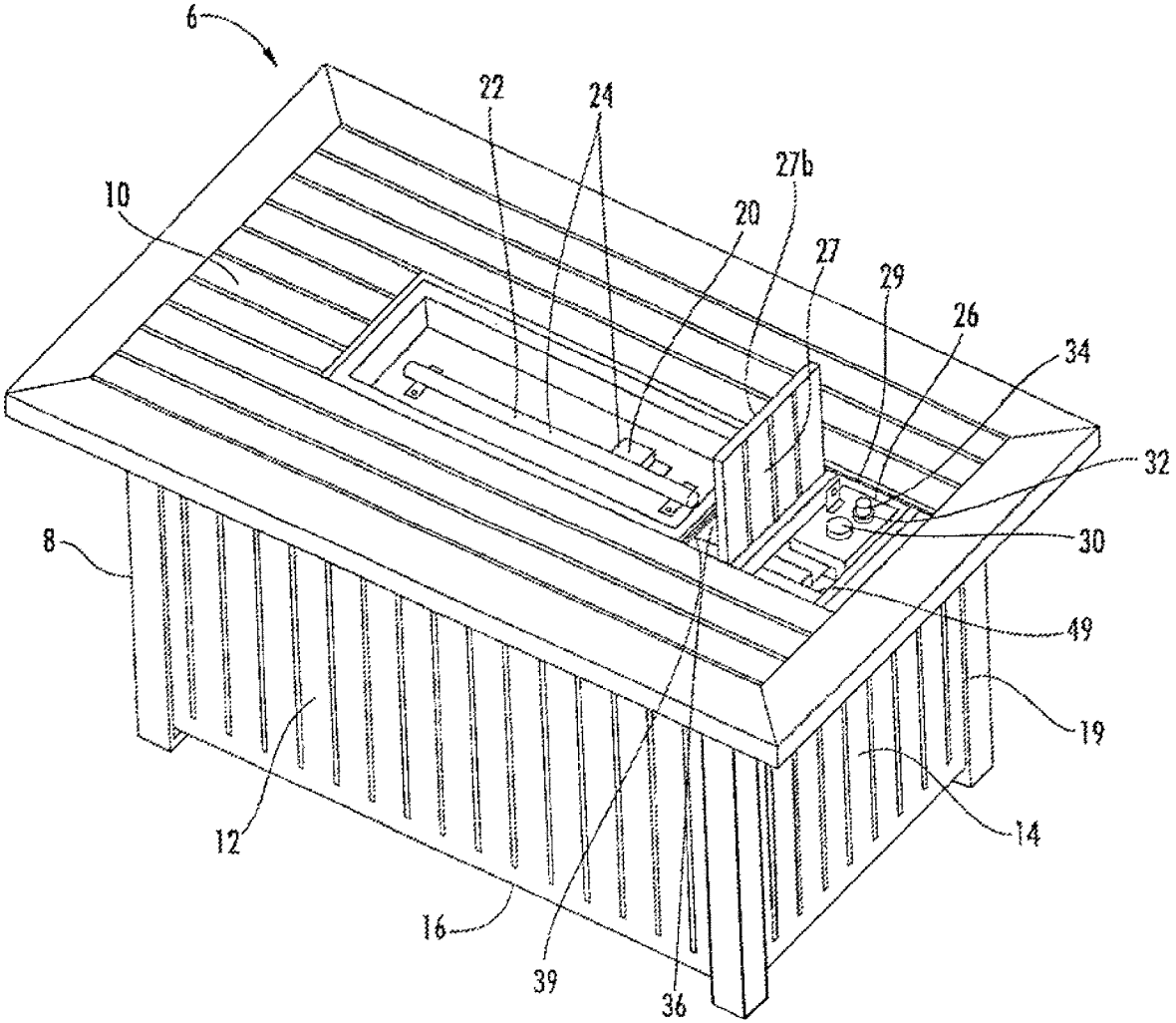
Figure 3:
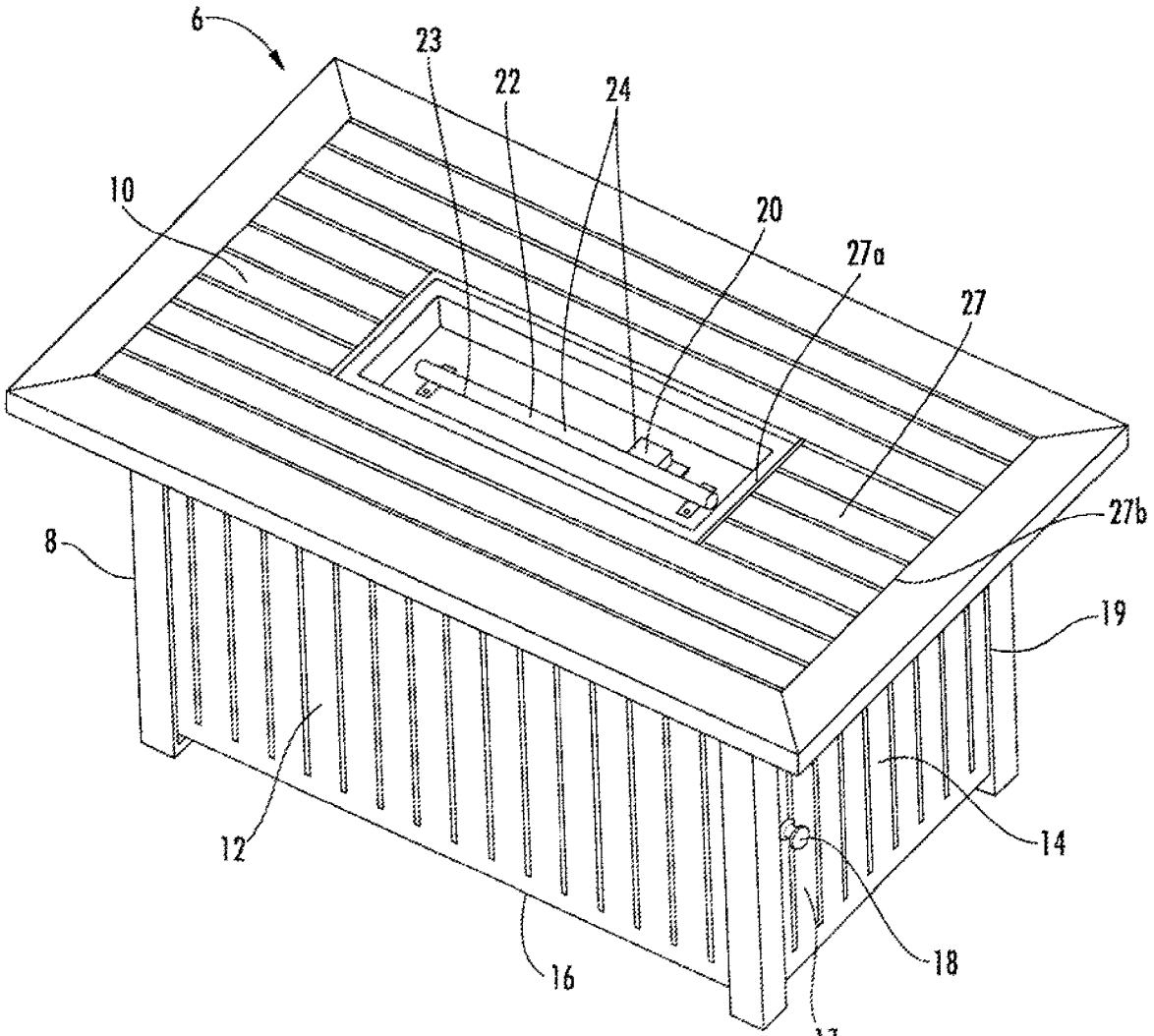
Figure 4:
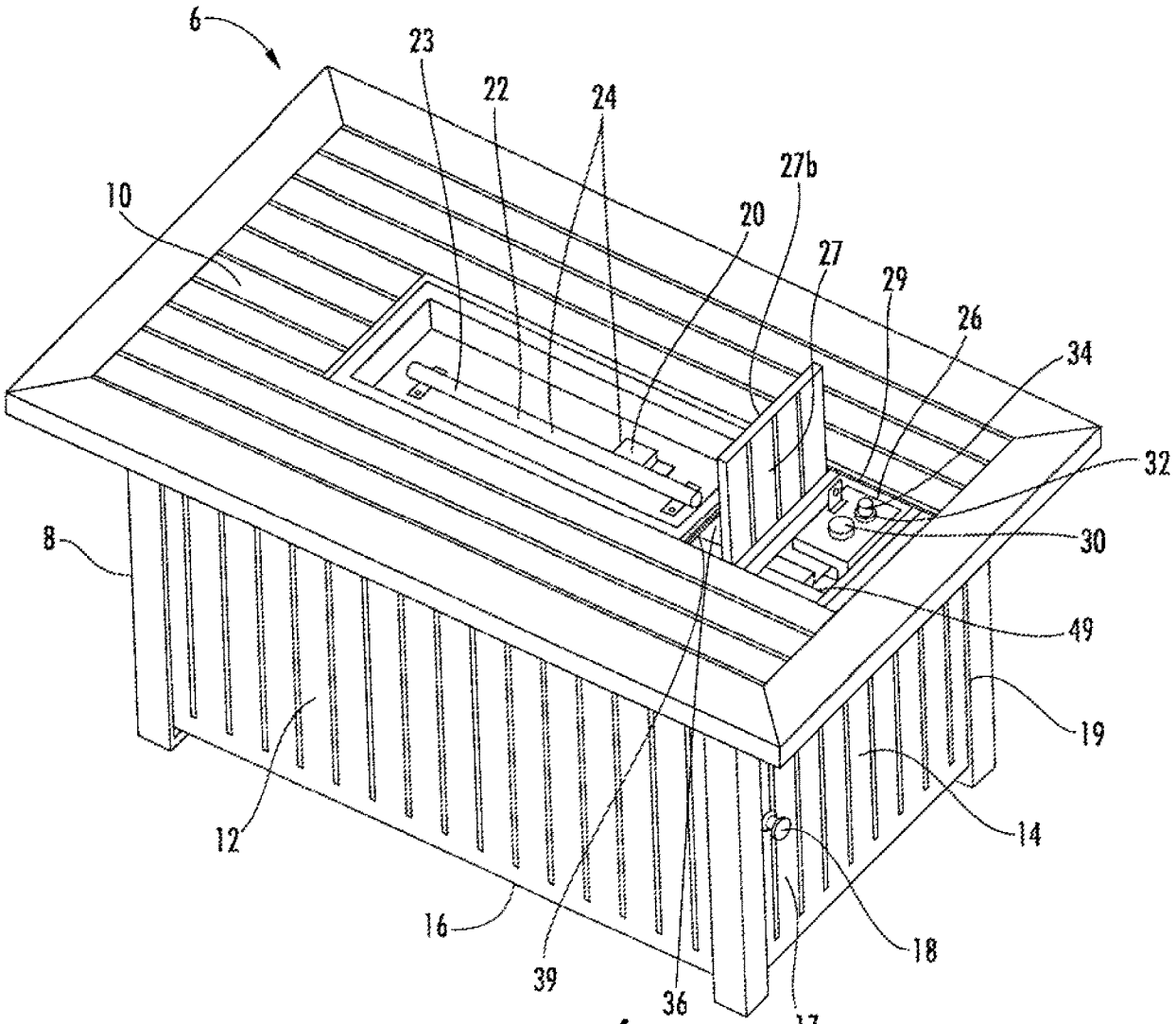

Having thus described embodiments of the invention in general terms, reference will now be made to the accompanying drawings, which are not necessarily drawn to scale, and wherein:

FIG. 1 is a top, left-side perspective view of a three-dimensional rendering of a fire pit apparatus according to one embodiment of the present invention;

FIG. 2 is a top, left-side perspective view of a three-dimensional rendering of the fire pit apparatus of FIG. 1 with the control and access panel open;

FIG. 3 is a top, left-side perspective view of a three-dimensional rendering of a fire pit apparatus with the control and access panel closed, according to a second embodiment of the present invention; and FIG. 4 is a top, left-side perspective view of a three-dimensional rendering of the fire pit apparatus of the fire pit apparatus of FIG. 3 with the control and access panel open.

DETAILED DESCRIPTION OF EMBODIMENTS OF THE INVENTION

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

In FIGS. 1 through 4, a fire pit apparatus 6 in accordance with the present invention is illustrated. The fire pit apparatus 6 is adapted to utilize natural or propane gas to fuel a contained fire. The fire pit apparatus 6 is designed primarily for outdoor use, such as in patio areas outside, but the design is also applicable to interior ventilated fire places and fire pits that use natural gas or propane as fuel. The design may also be used with other fuel-burning apparatuses, such as grills, insect traps, etc., that include a control assembly operatively and fluidly connected to the hose or piping between a fuel tank and a burner assembly.

As shown in FIGS. 1 through 4, the fire pit apparatus 6 has an enclosure 8. The enclosure 8 can have a variety of configurations, including, without limitation, polygonal, curvilinear, and combinations of the foregoing. In one embodiment, as shown in FIGS. 1-4, the enclosure 8 is rectangular and comprises a first lateral side 12, a second lateral side, a first end member 14, a second end member, a top or hearth 10, and a bottom 16. The enclosure 8 defines a first interior space or compartment bounded and defined by the first lateral side 12, the second lateral side, the first end member 14, the second end member, the top or hearth 10, and the bottom 16 and that is preferably of sufficient dimensions to house a fuel tank. In one embodiment, the enclosure 8 defines a first interior space or compartment of sufficient dimensions to house a standard 20 lb. propane tank, which is approximately 18 inches in height by 12.5 inches in diameter. In another embodiment, the enclosure 8 defines a first interior space or compartment of sufficient dimensions to house a 30 lb. propane tank, which is 24 inches in height by 12.5 inches in diameter. The enclosure 8 can be formed from any suitable material, such as a metal, ceramics (e.g., brick, stone, or tile), plastic, wood or other material. If the enclosure 8 is formed of a non-fire resistant material, preferably the top 10 of the enclosure 8 is formed of a fire-resistant material. For example, in one embodiment, the first lateral side 12, second lateral side, first end member 14, second end member, and bottom 16 can be constructed of wood or plastic, and at least the portion of the top 10 of the enclosure 8 surrounding the burner 22 can be formed from fire-resistant material, such as metal or a ceramic material.

As shown in FIGS. 3 and 4, the first end member 14 of the enclosure 8 includes at least a first door or access panel 17 secured to the enclosure 8 with hinges or other mechanical connectors or fasteners that allow movement (e.g., rotation) of at least three edges of the first door relative to, away from, the enclosure to enable access to the first interior space or compartment of the enclosure. Alternatively, the first door or access panel can be slidable along the first lateral side 12, the second lateral side, the first end member 14, or the second end member, or the top or hearth 10 between an open position allowing access to the first interior space or compartment and a closed position restricting access to the first interior space or compartment. The first door or access panel 17 may include a door knob 18 or other mechanism on the surface of the first door or access panel 17 that a user can grasp to open the first door or access panel 17 to thereby expose a first opening or aperture 19 and provide access to the first interior space or compartment of the enclosure 8. Although the first end member 14 is depicted as including a door in FIGS. 3 and 4, a first opening or aperture to the first interior space or compartment of the enclosure 8 may be located elsewhere about the enclosure 8. For example, the enclosure 8 may not have a bottom so that the enclosure 8 can be lifted and placed over a fuel tank to at least partially enclose or conceal the fuel tank. In another embodiment, one of the lateral sides may comprise a door that exposes a first opening or aperture when opened, providing access to the first interior space or compartment of the enclosure 8. In other embodiments, the enclosure 8 may include more than one door or access panel. Preferably, the first opening or aperture 19 to the first interior space or compartment of the enclosure 8 is of sufficient dimensions to insert or remove a fuel tank of a predetermined size (e.g., a standard 20 lb. propane tank or cylinder) into or out of the enclosure 8. After the installation of a fuel tank within the enclosure 8, a fuel line (e.g., hose or piping) is attached to the fuel tank by connecting a connector located at the distal end of the fuel line with a valve assembly on the fuel tank. As is well known in the art, the connector and valve assembly typically have a male/female connection in which the connector is threadably connected to corresponding threads on the valve assembly. In other embodiments, the base member of a quick-connect fitting or coupling may be threaded on to the valve assembly, which in turn matingly engages a second member connected to the distal end of the fuel line in a male/female connection, as is well known in the art.

As shown in FIGS. 2 through 4, the fire pit apparatus 6 includes a burner assembly 24 with a burner 22 and preferably an ignitor 20 for igniting fuel from the fuel tank. The top 10 of the enclosure 8 is preferably formed to receive and structurally support the burner assembly 24. For example, as illustrated in FIGS. 2-4, the burner assembly 24 may be mounted in a recessed area formed within the top 10, which recessed area extends into the first interior space or compartment. The ignitor 20 can be of the piezoelectric type, but other types of ignitors may also be used. The burner 22 can comprise a hollow tube or pipe with a plurality of burner ports 23 from which fuel is released and combusted to produce flames. The burner 22 can be constructed in any desired shape or configuration to create the desired fire effect or flame configuration, e.g., a straight tube, a ring, a polygon, etc.

Referring now to FIGS. 2 and 4, the enclosure 8 defines a second interior space or compartment 26. The enclosure 8 preferably includes a second door or access panel 27 secured to the enclosure 8 that may be moved to an open position to expose a second opening or aperture 29 when the second door or access panel 27 is opened thereby providing access to the second interior space or compartment 26 of the enclosure 8 and that may be moved to a closed position to restrict access to the second opening or aperture 29. For example, the second door or access panel 27 can be secured to the enclosure 8 with hinges or other mechanical connectors or fasteners that allow rotation of at least three edges of the second door relative to, away from, the enclosure that allow the second door or access panel 27 to flip open like a door or to rotate from a closed position to an open position. The second door or access panel 27 may also include a door knob or other mechanism on the surface of the second door or access panel 27 that a user can grasp to open the second door or access panel 27. The hinges or other mechanical connectors or fasteners securing the second door or access panel 27 to the enclosure 8 may be spring-loaded to bias the second door or access panel in an open position, as shown in FIG. 4. In such an embodiment, a releasable locking mechanism may be provided within the second interior space or compartment 26 that includes a release tab or the like that is structured to engage a latch secured to or embedded within the second door or access panel 27 to secure the second door or access panel within the second opening or aperture 29 in a closed position, as shown in FIG. 3. The user can release the releasable locking mechanism by depressing the second door or access panel 27 within the second opening or aperture 29 towards the second interior space or compartment 26, at which time the release tab disengages the latch in the second door or access panel 27 and the second door or access panel rotates away from the enclosure 8 to the open position.

Alternatively, as illustrated in FIGS. 2 and 4, in one embodiment, the second door or access panel 27 can be attached to the enclosure 8 using one or more rotatable rods or pins (e.g., that can be spring loaded and received within corresponding apertures in the sides of the enclosure 8 defining the second opening or aperture 29 and/or the second door or access panel 27), wherein the pins can be positioned and secured along the underside of the second door or access panel 27 offset from the center of the second door or access panel 27 so that the length from the rod or pins to a first end 27*a* of the second door or access panel 27 is greater than the length from the rod or pins to the opposite end 27*b* of the second door or access panel 27. This divides the second door or access panel 27 into a short section and a long section. In this embodiment, the enclosure 8 can define an additional opening or aperture 39 that provides access to an additional interior space or compartment 36, which can be different from or the same as the first interior space or compartment of the enclosure 8.

As illustrated in FIG. 4, the short section of the second door or access panel 27 can be rotated into the third opening or aperture 39 to thereby lift the long section of the second door or access panel 27 out of the second opening or aperture 29 to thereby expose the second opening or aperture 29 and provide access to the second interior space or compartment 26 of the enclosure 8. When the short section of the second door or access panel 27 is rotated into the third opening or aperture 39, an angle forms between the long section of the second door or access panel 27 and the plane of the top 10. This angle is preferably between 45 and 180 degrees and, more preferably, between 45 and 90 degrees. FIGS. 1 and 3 show the fire pit apparatus 6 with the second door or access panel 27 in the closed position and FIGS. 2 and 4 show the fire pit apparatus 6 with the second door or access panel 27 in the open position.

Referring to FIG. 4, the second opening or aperture 29 provides the user with access to the ignitor actuator 32 and fuel control assembly 30. The fuel control assembly 30 is operatively connected to a valve in the hose or piping between the fuel tank and the burner assembly 24 and can include a dial, knob, or slidable switch 34 that allows the user to incrementally adjust (e.g., open and close) the valve to adjust the amount of fuel being delivered from the fuel tank to the burner assembly 24 and, thus, the size and intensity of the fire in the fire pit. The ignitor actuator 32 is operatively connected to the ignitor 20 and, when pressed, activates the ignitor 20 to ignite fuel. It is also contemplated that the functions of the ignitor actuator 32 and the fuel control knob 30 can be combined and served by a single control rather than two separate controls.

The second opening or aperture 29 also provides the user with access to an additional opening or aperture 49. The additional opening or aperture 49 is preferably configured so as to accommodate a user's hand and forearm and provides access to the first interior space or compartment of the enclosure 8 so that the user can access the valve assembly of the fuel source (e.g., fuel tank or shut-off valve for a gas line as described below) quickly and easily. In one embodiment, the additional opening or aperture 49 is at least 4 inches wide and at least 4 inches long. In another embodiment, the additional opening or aperture 49 is 4 to 6 inches wide and 4 to 6 inches long. In another embodiment, the width and length of the additional opening or aperture 49 are the same and in another embodiment, the width and length of the additional opening or aperture 49 are the different. In one embodiment, the fuel tank is positioned within the first interior space or compartment of the enclosure 8 so that the valve assembly of the fuel source is adjacent to or directly beneath the additional opening or aperture 49. This enables the user to access the fuel control assembly 30 to incrementally adjust the fuel or to access the valve assembly of the fuel source to either shut off or open entirely the fuel supply from the fuel source.

In an alternate embodiment, it is also contemplated that the fire pit apparatus 6 can be connected to an underground gas line, such as provided by a gas utility, instead of a fuel tank. This embodiment eliminates the need for the first interior space or compartment to be of sufficient dimensions to house a fuel tank; however, since such fuel lines typically include a shut-off valve, the additional opening or aperture 49 provides an ergonomically designed and positioned access to the shut-off valve inside the enclosure 8.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation. In addition, where possible, any terms expressed in the singular form herein are meant to also include the plural form and/or vice versa. As used herein, "at least one" shall mean "one or more" and these phrases are intended to be interchangeable. Accordingly, the terms "a" and/or "an" shall mean "at least one" or "one or more," even though the phrase "one or more" or "at least one" is also used herein.

That which is claimed:

1. A fire pit apparatus, the comprising:

an enclosure;

a burner assembly comprising a burner;

at least one control assembly;

an elongate hollow member being operatively and fluidly connected to the burner assembly and control assembly;

wherein, the enclosure defines a first aperture and a first compartment and a second aperture and a second compartment, wherein the first aperture provides access to the first compartment and the second aperture provides access to the second compartment and wherein the second compartment defines a third aperture that provides access to the first compartment, wherein the enclosure comprises a door either within or adjacent to the second aperture, the door configured to be moved between an open position providing access to the second compartment and a closed position restricting access to the second compartment, and wherein the enclosure comprises a rotatable connector attached to the door, the connector configured to be secured to the door in a position that is offset from the center of the door so that the length from the connector to one end of the door is greater than the length from the connector to the opposite end of the door thereby dividing the door into a long section and a short section.

2. The fire pit apparatus of claim 1, wherein the burner is positioned on or at least partially within the surface of the enclosure.

3. The fire pit apparatus of claim 1, wherein the enclosure defines a fourth aperture structured to receive the short section of the door when the door is in the open position and provides access to the first compartment.

4. The fire pit apparatus of claim 1, wherein the burner assembly comprises an ignitor and wherein the ignitor is operatively connected to the at least one control assembly.

5. A fire pit apparatus fueled by a gaseous fuel source having a shut-off valve, the fire pit apparatus comprising:

an enclosure;

a burner assembly comprising a burner and is structured to be connected to the fuel source;

at least one control assembly;

an elongate hollow member being operatively and fluidly connected to the burner assembly, the control assembly and the fuel source; and wherein, the enclosure defines a first aperture and a first compartment and a second aperture and a second compartment, wherein the first compartment is structured to contain the shut-off valve, wherein the first aperture provides access to the first compartment and the second aperture provides access to the second compartment and wherein the second compartment defines a third aperture that provides access to the first compartment and the shut-off valve, wherein the enclosure comprises a door either within or adjacent to the second aperture, the door configured to be moved between an open position providing access to the second compartment and a closed position restricting access to the second compartment, and wherein the enclosure comprises a rotatable connector attached to the door secured to the door in a position that is offset from the center of the door so that the length from the connector to one end of the door is greater than the length from the connector to the opposite end of the door thereby dividing the door into a long section and a short section.

6. The fire pit apparatus of claim 5, wherein the enclosure defines a fourth aperture structured to receive the short section of the door when the door is in the open position and provides access to the first compartment.

7. The fire pit apparatus of claim 5, wherein the burner assembly comprises an ignitor and wherein the ignitor is operatively connected to the at least one control assembly.

8. A fire pit apparatus, the fire pit apparatus comprising:

a gaseous fuel source comprising a shut-off valve;

an enclosure;

a burner assembly comprising a burner;

at least one control assembly;

an elongate hollow member being operatively and fluidly connected to the burner assembly, the control assembly and the gaseous fuel source; and wherein, the enclosure defines a first aperture and a first compartment and a second aperture and a second compartment, wherein the first compartment contains the shut-off valve, wherein the first aperture provides access to the first compartment and the second aperture provides access to the second compartment and wherein the second compartment defines a third aperture that provides access to the first compartment and the shut-off valve, wherein the enclosure comprises a door either within or adjacent to the second aperture and is configured to be moved between an open position providing access to the second compartment and a closed position restricting access to the second compartment, wherein the enclosure comprises a rotatable connector attached to the door and is configured to be secured to the door in a position that is offset from the center of the door so that the length from the connector to one end of the door is greater than the length from the connector to the opposite end of the door thereby dividing the door into a long section and a short section.

9. The fire pit apparatus according to claim 8, wherein the fuel source comprises a standard 20 lb. propane tank and the first aperture is configured to receive a standard 20 lb. propane tank.

10. The fire pit apparatus according to claim 8, wherein the second and third apertures are not configured to receive a standard 20 lb. propane tank.

11. The fire pit apparatus of claim 8, wherein the enclosure defines a fourth aperture is configured to receive the short section of the door when the door is in the open position and provides access to the first compartment.

12. The fire pit apparatus of claim 8, wherein the burner assembly comprises an ignitor and wherein the ignitor is operatively connected to the at least one control assembly.

* * * * *